United States Patent [19]

Engelhart

[11] 4,312,505

[45] Jan. 26, 1982

[54] INVALID'S WHEELED WALKER

[76] Inventor: Raymond E. Engelhart, Rte. 4, Park Rapids, Minn. 56470

[21] Appl. No.: 136,276

[22] Filed: Apr. 1, 1980

[51] Int. Cl.[3] ..... A61H 3/00

[52] U.S. Cl. ..... 272/70.3

[58] Field of Search ..... 272/70, 70.3, 70.4; 280/200, 228, 289 R, 290, 135; 128/80

[56] References Cited

U.S. PATENT DOCUMENTS

| | | | |
|---|---|---|---|
| 97,078 | 11/1869 | Gaulding | 272/70.3 |
| D. 112,691 | 12/1938 | Comper | 272/70.3 U X |
| 1,727,969 | 9/1929 | Evans | 272/70.3 |
| 2,077,569 | 4/1937 | Kish | 280/200 X |
| 2,285,778 | 6/1942 | Milward | 272/70 |
| 2,556,121 | 6/1951 | Thomas | 272/70.3 |
| 2,734,554 | 2/1956 | Ries | 272/70.3 |
| 3,708,182 | 1/1973 | Markiel | 272/70.3 |
| 4,029,311 | 6/1977 | Chanslor et al. | 272/70.3 |
| 4,212,493 | 7/1980 | Ledesky | 272/70.3 |

FOREIGN PATENT DOCUMENTS

| | | | |
|---|---|---|---|
| 1180387 | 12/1958 | France | 272/70.3 |
| 832913 | 4/1960 | United Kingdom | 272/70.3 |

OTHER PUBLICATIONS

"Popular Mechanics", Jan. 1959, pp. 214, 215.

*Primary Examiner*—Richard C. Pinkham
*Assistant Examiner*—T. Brown
*Attorney, Agent, or Firm*—Raymond N. Matson

[57] ABSTRACT

A foldable wheeled walker for invalids having front caster wheels for steering and a tubular, braced, three sided frame with strategically positioned, padded hand grips, the frame having a vertically adjustable padded leaning rest for the forearms in the front to which a safety hand hold bar including rear wheel brake controls is fixed as well as an adjustable, detachable safety belt for the user. A removable rear cross bar and belt is also provided to support the rear of the front belt when in use.

6 Claims, 8 Drawing Figures

FIG. 4
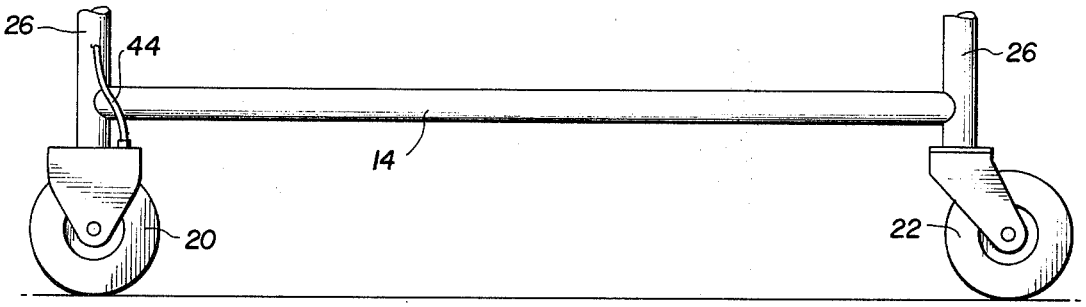
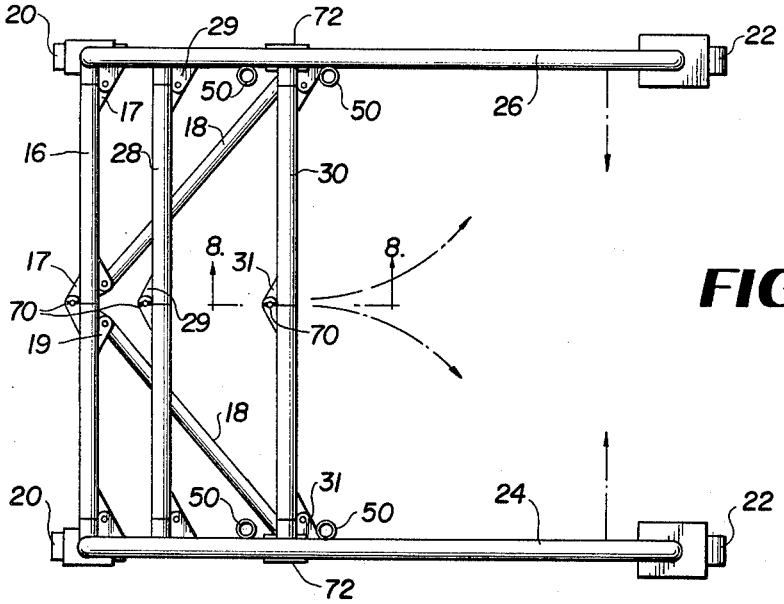
FIG. 5
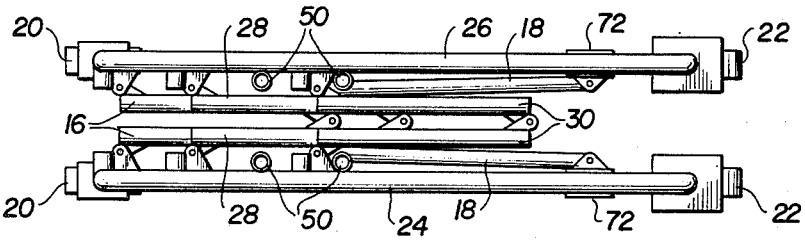
FIG. 6
FIG. 7
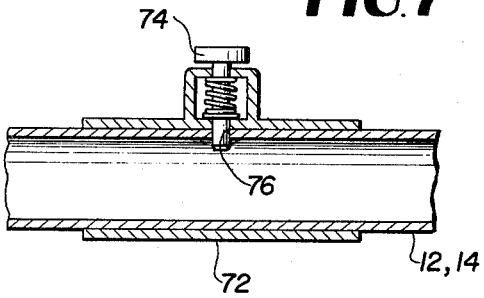
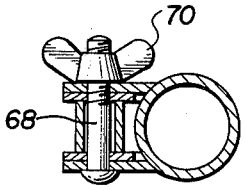
FIG. 8

INVALID'S WHEELED WALKER

This invention relates generally to walking aids for invalids and more particularly to an improved walker which enables a maximum of walking exercise by an invalid with respiratory and/or other problems while requiring a minimum of effort without the constant pressure of an attendant.

Walkers of this general type are known in the art but insofar as is known, all are characterized by one or more inherent disadvantages. Among these are structures; which lack safety supports in the case of fainting and falling so as to require the close and constant presence of an attendant; structures which require too much physical effort on the part of the patient; and structures which involve complicated harness unmanageable by the patient alone.

Accordingly, the main object of the present invention is to provide an improved wheeled walker for invalids which obviates the foregoing and other disadvantages characterizing known structures.

An important object of the present invention is to provide an improved wheeled walker for invalids which enables I.V. feeding or the taking of oxygen by the patient while walking with the aid of the walker.

Another important object of the present invention is to provide an improved walker which enables a respiratory patient to assume his most comfortable position—leaning slightly forward while standing and leaning downwardly on something with his forearms—thus avoiding upward pressure on his diaphragm.

A further important object of the present invention is to provide an improved wheeled walker for heart patients which is so constructed and arranged as to eliminate any pushing, pulling or stretching of the arm, chest or back muscles while walking.

A still further important object of the present invention is to provide an improved wheeled walker for invalids which is susceptible of ready and economic manufacture, and which is strong and of long life in use.

Other objects and advantages of the invention will become apparent during the course of the following description.

In the drawings, I have shown two embodiments of the invention. In these showings:

FIG. 4 is a fragmentary right side elevational view of the walker showing one of the cable controls for the rear wheel brakes.

FIG. 5 is a top plan view of the walker in fold-a-way form;

FIG. 6 is a similar view in fully folded condition;

FIG. 7 is a sectional view of a sleeve locking means detail; and

FIG. 8 is a similar view taken on the line 8—8 of a pivot joint locking detail.

Figure 1:
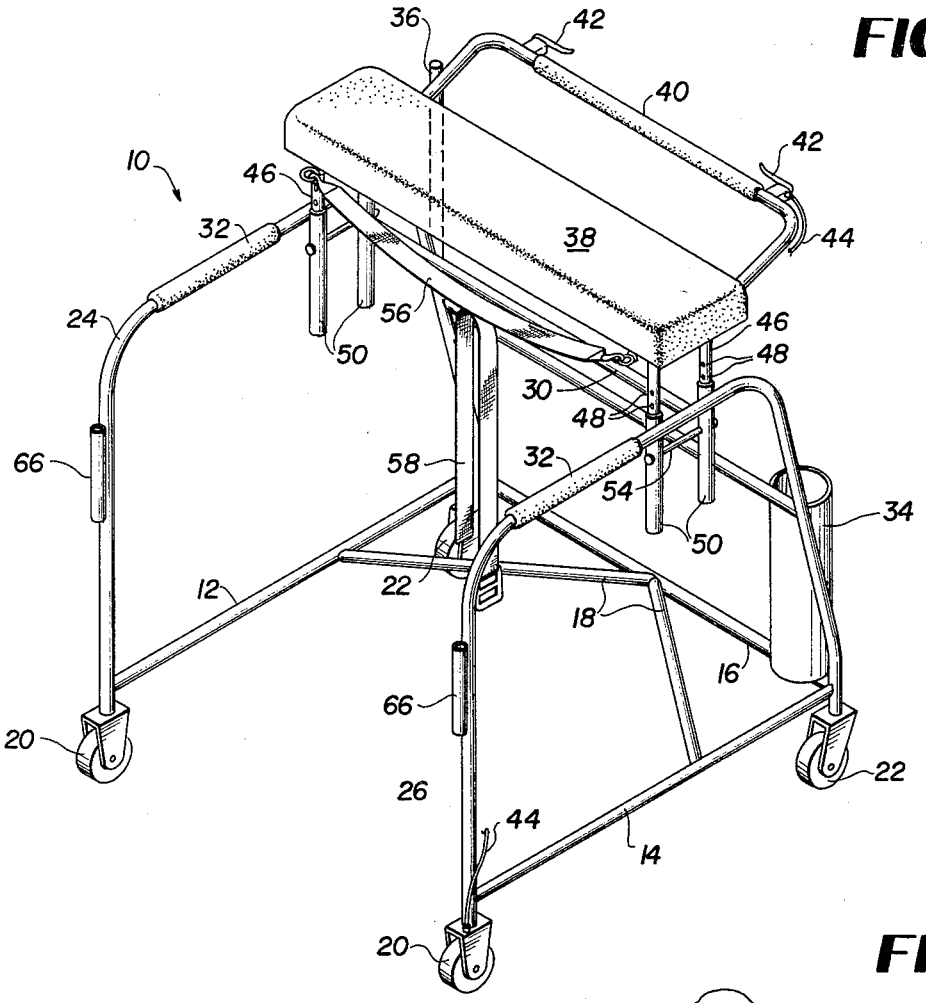
FIG. 1 is a rear perspective view of the wheeled walker comprising the present invention.

Referring towalker as a whole which comprises a strong tubular, three sided, and substantially waist high frame of aluminum or steel having lower side bars 12 and 14 rigidly connected to a front bar 16 and all being braced by diagonal bars 18. The lower frame is mounted on rear wheels 20 and front caster wheels 22 for steering.

The frame which is open at the rear, also includes inverted generally U-shaped side bars 24 and 26 rigidly connected at the front by a cross bar 28 and at the top forward portion by a cross bar 30. The tops of the bars 24 and 26 include padded hand grips 32 of naugahide or other suitable washable material. A tubular bracket 34 for the reception of a portable oxygen bottle is mounted on the front bar 16 and is fixed to it and to the upper front bar 28. A second tubular bracket 36 for the reception of an I.V. pole is fixed to the upper front of the side bar 24 and both brackets are also covered with naugahide, etc.

Figure 2:
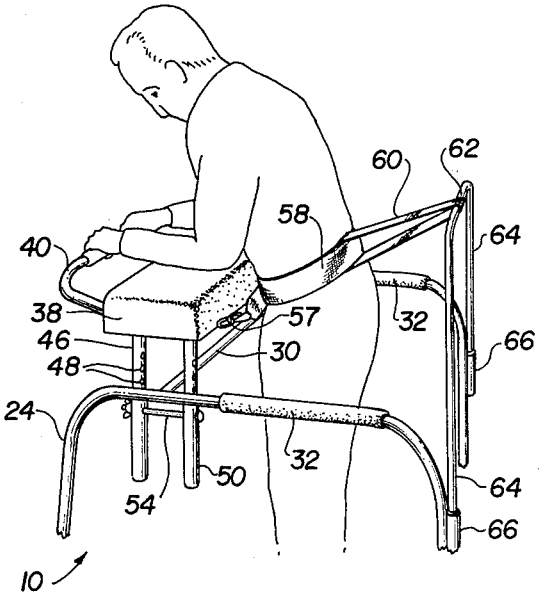
FIG. 2 is a perspective view thereof showing the manner of use of the walker by an invalid.
Figure 3:
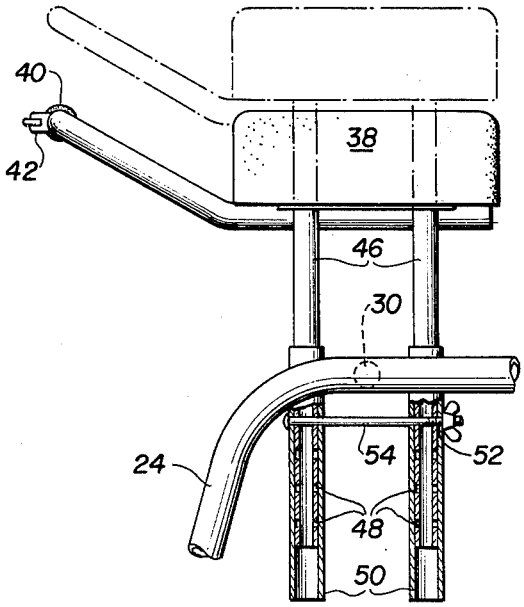
FIG. 3 is a fragmentary side elevational view thereof showing the adjustable mounting of the combination arm rest and hand hold bar.

An important feature of the present invention resides in the padded leaning rest 38 and its forwardly projecting U-shaped safety hand hold bar 40 which is also naugahide, etc. covered and provided with brake control handles 42. These individually control the bicycle-type rear wheel brakes (not shown) by means of cables 44. As shown in FIGS. 1 and 2, an extra loop of the cables 44 is provided adjacent the handles 42 so as to enable the removal of the rest 38 to rotate 90 degrees and rest on top of the walker when folded as is shown in FIG. 6 and as will be described.

The padded leaning rest 38 and its attached hand hold bar 40 is made vertically adjustable by means of four depending tubular posts 46 each of which includes a plurality of vertically spaced, diametrically opposite apertures 48. The four posts are received in tubular sockets 50 which are similarly positioned and rigidly fixed to the front top portions of the side bars 24 and 26.

The sockets 50 are each provided with one pair of diametrically opposed apertures 52 for the reception of a bolt 54 inserted therethrough and through a pair of the post apertures 48 when the leaning rest is in its desired position of vertical adjustment. Thus, the leaning rest is readily adjustable to the height of the invalid user.

Falling of the patient due to fainting, fatigue, etc. is prevented by the use of a strap 56 fixed at its ends to the leaning rest 38 (FIG. 1) and at its midpoint to a waist-encircling buckled belt 58. The patient is further provided with a second belt 60 to ensure its vertical position when unconscious or too weak to stand. The belt 60 passes around the waist encircling belt 58 (FIG. 2) and is attached to and centrally of an inverted U-shaped rear cross bar 62 whose two lower ends 64 are detachably received in a tubular bracket 66 fixed to the top rear of the side bars 24 and 26. When not in use, the rear cross bar 62 and the belt 60 may be removed and placed on the front of the walker 10.

As shown in FIGS. 5–8 wherein similar parts bear similar numbers, the front and top cross bars 16, 28 and 30 and the diagonal brace bars 18 are provided with central and end pivots 17, 29, and 31 and at 19 so as to enable the bars to fold rearwardly as shown in FIG. 5 to comprise a readily portable walker 10. It will be noted that the central pivots are each provided with a pivot bolt 68 and a locking wing nut 70 to maintain either position of the walker. However, the rear ends of the diagonal braces 18 are provided with sleeves 72 which slide along the side bars 12 and 14 to open or folded position in which they are maintained by spring loaded bolts 74 engaging in apertures 76 (FIG. 7).

In use, the patient pulls him or herself by the hand grips 32 up and through the rear opening of the walker 10 to a position closely adjacent the rear of the leaning rest 38 which is then adjusted to the proper height for the forearms if necessary. While the patient holds onto the safety hand hold bar, the belt 58 is first buckled around his waist and then the second belt 60 is connected through it. The patient is now free to safely walk about as desired as he is vertically supported by the belts, may steer the walker by the front caster wheels, and may brake the speed of the walker by the brake handles 42 while traversing an incline. If desirable, the I.V. pole may be placed in the bracket 36 and/or an oxygen bottle may be placed in the bracket 34.

It will now be apparent that the walker 10 provides many novel advantages not present in prior art structures despite its relatively simple construction and may be readily used by patients of any height or size with a minimum of assistance to obtain a maximum of non-dangerous exercise.

It is to be understood that the forms of my invention herewith shown and described are to be taken as preferred examples of the same and that various changes in the shape, size and arrangement of parts may be resorted to without departure from the spirit of the invention or the scope of the subjoined claims.

What is claimed is:

1. A wheeled walker for invalids comprising, in combination, a tubular three sided frame open at the rear; upstanding inverted U-shaped side bars mounted on said frame; cross bars rigidly connecting the front and tops of said side bars; a pair of vertically disposed, spaced sockets mounted on each of said side bars; a leaning rest for the forearms having mating depending tubular supports mounted in said sockets; a hand hold bar fixed to and projecting forwardly of said leaning rest; waist encircling belt means fixed to and substantially centrally of said leaning rest; a tubular bracket fixed to the top rear of each said side bar; a third inverted U-shaped bar insertable in said brackets; and a second belt fixed to said third bar to encircle and support the rear of said first belt when encircling an invalid.

2. The combination recited in claim 1 wherein said sockets and said supports include means for adjusting the height of said leaning rest.

3. The combination recited in claim 1 wherein a tubular bracket is mounted on said frame for the reception of a portable oxygen tank.

4. The combination recited in claim 1 wherein a tubular bracket is mounted on said frame for the reception of an I.V. pole.

5. The combination recited in claim 1 wherein the rear wheels of said walker include brakes; and brake control handles are mounted on said hand hold bar.

6. The combination recited in claim 1 wherein said cross bars are pivotable at their mid and end points to enable their folding against each other and said side bars and frame.

* * * * *